US006345771B1

(12) United States Patent
Gromek et al.

(10) Patent No.: US 6,345,771 B1
(45) Date of Patent: Feb. 12, 2002

(54) MULTIPLE STACK PIEZOELECTRIC ACTUATOR FOR A FUEL INJECTOR

(75) Inventors: Bogdan Gromek, Yorktown; Jingming Jim Shen, Newport News, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,537

(22) Filed: Jun. 30, 2000

(51) Int. Cl.[7] ..... F02D 1/06; B05B 1/08

(52) U.S. Cl. ..... 239/5; 239/102.2; 239/453; 239/584; 251/129.06; 310/311; 310/328

(58) Field of Search ..... 239/5, 102.1, 102.2, 239/453, 584; 251/129.06; 310/311, 328

(56) References Cited

U.S. PATENT DOCUMENTS

| | | | | |
|---|---|---|---|---|
| 4,022,166 A | | 5/1977 | Bart | |
| 4,550,744 A | | 11/1985 | Igashira et al. | |
| 4,584,980 A | | 4/1986 | Weiger et al. | |
| 4,725,002 A | | 2/1988 | Trachte | |
| 4,750,706 A | | 6/1988 | Schlagmuller | |
| 5,169,067 A | * | 12/1992 | Matsusaka et al. | 239/102.2 |
| 5,186,151 A | | 2/1993 | Schwerdt et al. | |
| 5,740,969 A | | 4/1998 | Hoffmann et al. | |
| 5,810,255 A | | 9/1998 | Itoh et al. | |
| 5,819,710 A | | 10/1998 | Huber | |
| 6,079,636 A | | 6/2000 | Rembold et al. | |
| 6,148,842 A | | 11/2000 | Kappel et al. | |

FOREIGN PATENT DOCUMENTS

| | | |
|---|---|---|
| DE | 43 06 072 C2 | 2/1993 |
| DE | 43 06 073 C1 | 2/1993 |
| DE | 44 06 522 C1 | 2/1994 |
| DE | 44 12 948 A1 | 4/1994 |
| DE | 195 04 175 A1 | 2/1995 |
| DE | 195 29 667 A1 | 8/1995 |
| DE | 197 27 992 A1 | 7/1997 |
| DE | 197 50 149 A1 | 11/1997 |
| DE | 198 04 196 A1 | 2/1998 |
| DE | 198 34 461 A1 | 7/1998 |
| DE | 198 34 673 A1 | 7/1998 |
| DE | 198 36 561 A1 | 8/1998 |
| DE | 198 38 862 A1 | 8/1998 |
| DE | 198 57 338 C1 | 12/1998 |
| DE | 199 52 946 A1 | 11/1999 |
| EP | 0 795 081 B1 | 11/1995 |
| WO | WO 98/44256 | 10/1998 |

* cited by examiner

*Primary Examiner*—Steven J. Ganey

(57) ABSTRACT

A fuel injector comprises a tube assembly, a seat secured at an end of the tube assembly, a stem assembly movable with respect to the seat, a first set of piezoelectric elements connected to the stem assembly, and a second set of piezoelectric elements connected to the first set of piezoelectric elements. The tube assembly has a longitudinal axis extending between a first end and a second end and the seat defines an opening. The stem assembly moves along the axis between a first position wherein the stem assembly contiguously engages the seat such that fuel flow through the opening is prevented and a second position wherein the stem assembly is spaced from the seat such that fuel flow through the opening is permitted. The first set of piezoelectric elements electromechanically extend and contract along the axis in response to a first electric field, and the second set of piezoelectric elements electromechanically extend and contract along the axis in response to a second electric field.

16 Claims, 2 Drawing Sheets

Piezoelectric actuator assembly, 50
Second set of piezoelectric elements, 54
First set of piezoelectric elements, 52
Example 1
Example 2
Example 3
Example 4
ℓ
V
t

MULTIPLE STACK PIEZOELECTRIC ACTUATOR FOR A FUEL INJECTOR

BACKGROUND OF THE INVENTION

The present invention relates to an actuator for a fuel injector, and more particularly to a fuel injector actuator having a plurality of sets of piezoelectric elements.

A conventional piezoelectric element is a ceramic structure whose axial length changes in the presence of an electric field created by applying a voltage across the element. In typical applications, the axial length of the element can change by, for example, approximately 0.12%. In a stacked configuration of elements, the change in the total axial length of the stack is equal to the sum of the changes in axial length of each element in the stack. As is known, applying a voltage to a piezoelectric element, or to a stack of piezoelectric elements, results in a nearly instantaneous expansion of the actuator and an instantaneous movement of any structure connected to the actuator.

It is known to use a single set of piezoelectric elements, i.e., a stack of piezoelectric elements across which a common voltage is applied, to actuate a fuel injector for an internal combustion engine. Such piezoelectric actuators precisely open and close an injector valve element for precisely metering fuel flow into a combustion chamber.

The thermal and pressure effects present in the piezoelectrically actuated injector's operating environment can cause dimensional changes within the injector. These dimensional changes result in a change to the injector's stroke, causing an unstable shift in its flow characteristics. To compensate for the dimensional changes, it is known to fabricate injectors from exotic materials, which exhibit low thermal expansion. In addition, it is also known to calibrate injector strokes to anticipate elongation of the valve body. However, these methods are costly and inefficient.

SUMMARY OF THE INVENTION

Advantages of the claimed invention include increasing the stroke of the piezoelectric stack, compensating for thermal expansion in different operating condition, and compensating for mechanical deformation under different fuel pressures and assembly stresses.

The present invention provides a fuel injector that comprises a tube assembly having a longitudinal axis extending between a first end and a second end; a seat secured at the second end of the tube assembly and defining an opening; a stem assembly movable with respect to the seat, the stem assembly moving between a first position wherein the stem assembly contiguously engages the seat such that fuel flow through the opening is prevented and a second position wherein the stem assembly is spaced from the seat such that fuel flow through the opening is permitted; a first set of piezoelectric elements moving the stem assembly in response to a first electric field; and a second set of piezoelectric elements moving the first set of piezoelectric elements in response to a second electric field.

The present invention also provides a fuel injector that comprises a tube assembly having a longitudinal axis extending between a first end and a second end; a seat secured at the second end of the tube assembly and defining an opening; a stem assembly movable with respect to the seat, the stem assembly moving along the axis between a first position wherein the stem assembly contiguously engages the seat such that fuel flow through the opening is prevented and a second position wherein the stem assembly is spaced from the seat such that fuel flow through the opening is permitted; a first set of piezoelectric elements connected to the stem assembly, the first set of piezoelectric elements electromechanically extending and contracting along the axis in response to a first electric field; and a second set of piezoelectric elements connected to the first set of piezoelectric elements, the second set of piezoelectric elements electromechanically extending and contracting along the axis in response to a second electric field.

The present invention also provides a method of actuating a fuel injector. The fuel injector includes a tube assembly having a longitudinal axis extending between a first end and a second end, a seat secured at the second end of the tube assembly and defining an opening, a stem assembly movable with respect to the seat, the stem assembly moving along the axis between a first position wherein the stem assembly contiguously engages the seat such that fuel flow through the opening is prevented and a second position wherein the stem assembly is spaced from the seat such that fuel flow through the opening is permitted, a first set of piezoelectric elements connected to the stem assembly, and a second set of piezoelectric elements connected to the first set of piezoelectric elements. The method comprises applying a first electric field to the first set of piezoelectric elements, the first set of piezoelectric elements electromechanically extending and contracting along the axis in response to the first electric field; and applying a second electric field to the second set of piezoelectric elements, the second set of piezoelectric elements electromechanically extending and contracting along the axis in response to the second electric field.

BRIEF DESCRIPTION OF THE DRAWINGS

The accompanying drawings, which are incorporated herein and constitute a part of this specification, illustrate embodiments of the invention, and, together with the general description given above and the detailed description given below, serve to explain features of the invention.

DETAILED DESCRIPTION OF THE PREFERRED EMBODIMENTS

A fuel injector can include a piezoelectric multi-element actuator that changes in length in response to an electric field, which is created by a control voltage applied across the piezoelectric elements. The actuator can be coupled to a valve member for opening and closing the fuel injector.

Figure 1:
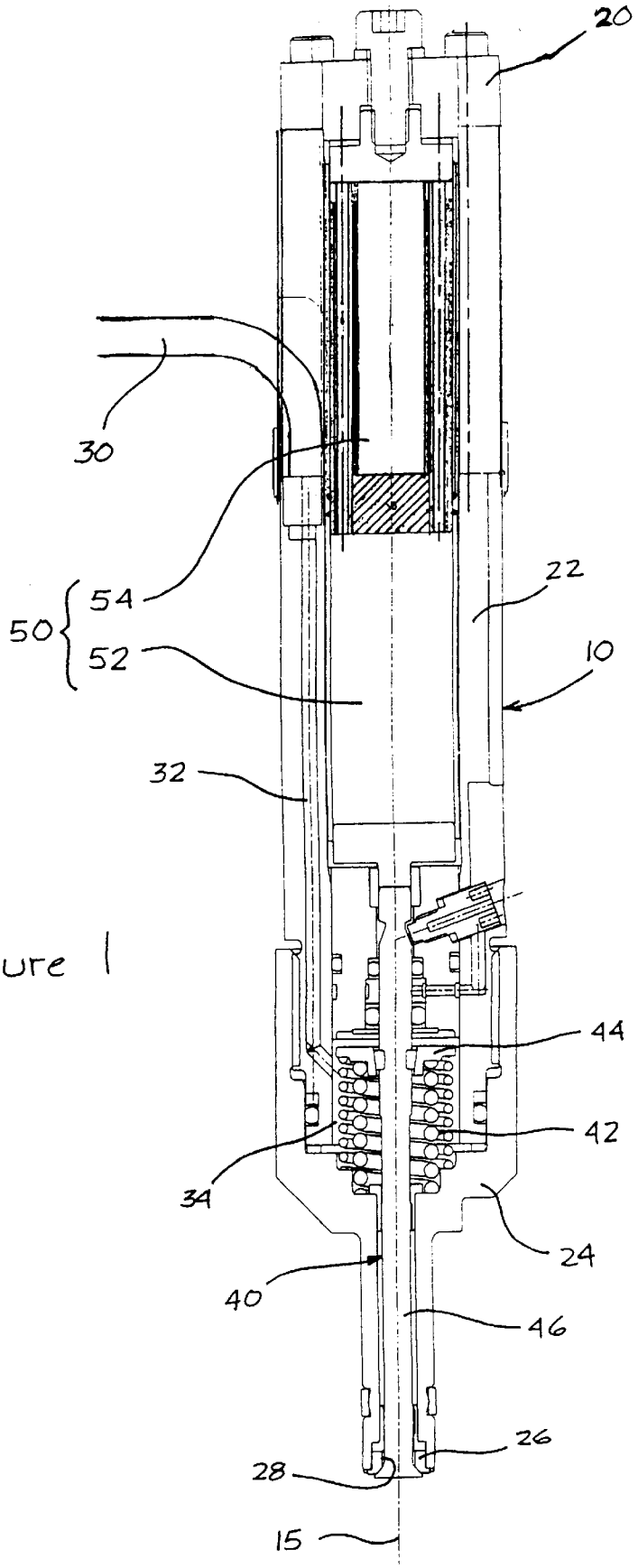
FIG. 1 is a cross-sectional view of a fuel injector including a piezoelectric actuator according to the claimed invention.

Referring to FIG. 1, a fuel injector includes a tube assembly 10 having a first end portion 20, a central portion 22, and a valve body 24 at a second end portion. The first portion 20, central portion 22, and valve body 24 can be aligned along an axis 15 and can be fixed together. A seat 26 having an opening 28 is fixed to the valve body 24 at an opposite end from the central portion 22. Fuel can be supplied via a fuel inlet 30 and a fuel passage 32 in the central portion 22. A chamber 34 connects the fuel passage 32 to the opening 28.

A stem assembly 40 extends along the axis 15 and is reciprocally motivated with respect to the seat 26. The stem assembly 40 moves between a first position wherein the stem assembly 40 contiguously engages the seat 26 such that fuel flow through the opening 28 is prevented and a second position wherein the stem assembly 40 is spaced from the seat 26 such that fuel flow through the opening 28 is permitted. A resilient element 42 biases the stem assembly 40 toward the first position. For example, as shown in FIG. 1, the stem assembly 40 can include a collar 44 fixed to a stem 46, and the resilient element 42 can include two coil springs having opposite ends engaging the valve body 24 and the collar 44.

The stem assembly 40 is displaced toward the first position by a piezoelectric actuator assembly 50. According to the claimed invention, the piezoelectric actuator includes at least a first set of piezoelectric elements 52 and a second set of piezoelectric elements 54 that are assembled together in series, and can be commonly aligned the axis 15. These two sets 52,54 can operate individually or simultaneously; the control voltages, and hence the electric fields, for each set 52,54 can be static or dynamic; and the stack lengths can be equal or different, as needed and available.

The total length change of the first and second sets of piezoelectric elements 52,54 is exactly the summation of the individual stacks, which are themselves the summation of the length changes for each individual element in their respective stack.

Figure 2:
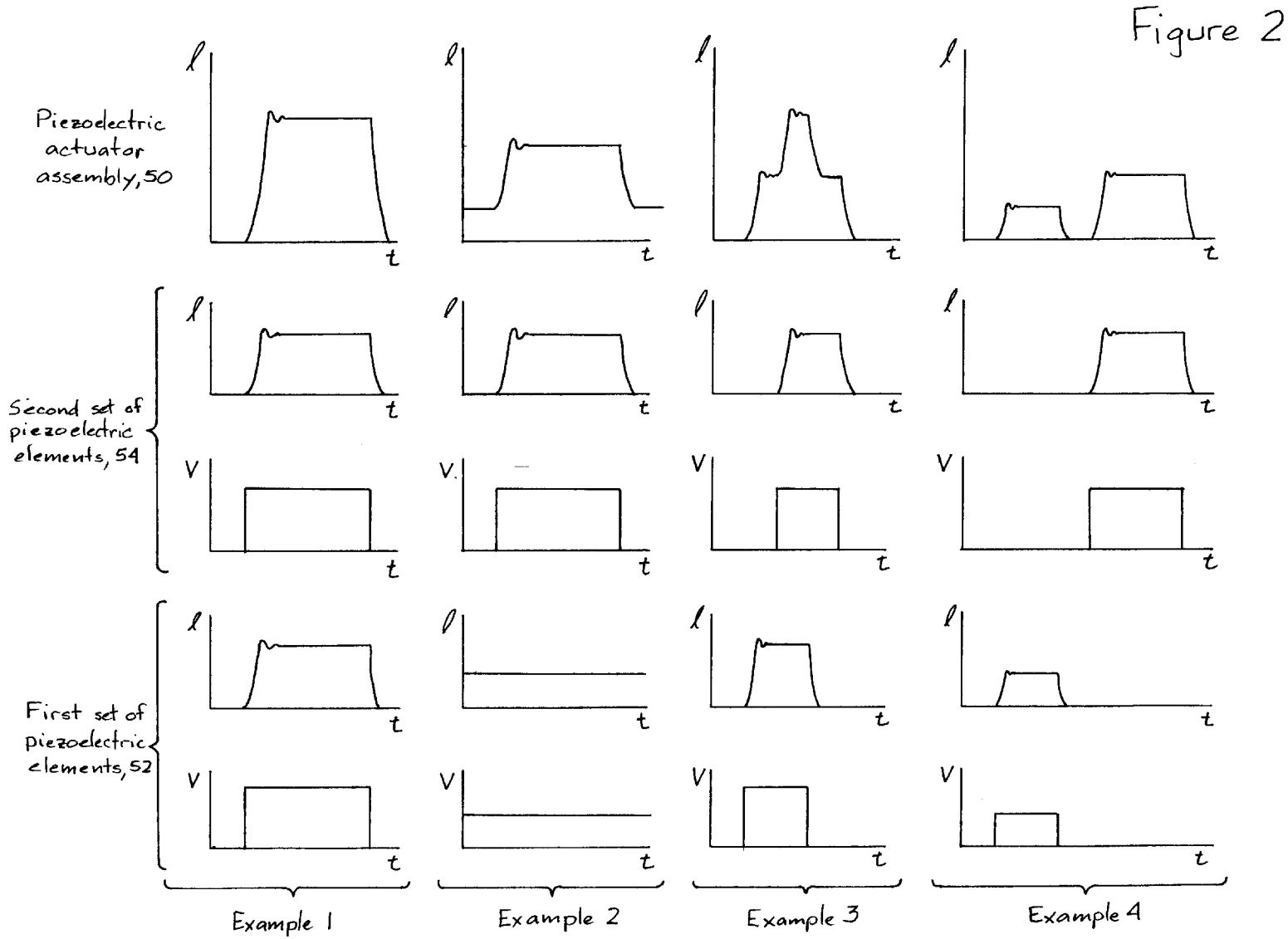
FIG. 2 is a diagram illustrating four examples of lift summation for a piezoelectric actuator having two sets of piezoelectric elements according to the claimed invention.

Accordingly, the claimed invention can improve piezoelectric actuator fuel injector performance and control flexibility. For example, referring to FIG. 2, plural sets of piezoelectric elements can increase the valve lift, compensate for component length changes due to thermal loads and mechanical loads, or shape the lift trace. Of course, FIG. 2 illustrates only a few of the lift traces that are possible.

The claimed invention is not limited to two sets of piezoelectric elements, and can include three or more sets of piezoelectric element sets. Of course, different control voltages, and hence electric fields, can be applied to two or more of the sets of piezoelectric elements.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What we claim is:

1. A fuel injector comprising:

a tube assembly having a longitudinal axis extending between a first end and a second end;

a seat secured at the second end of the tube assembly, the seat defining an opening;

a stem assembly movable with respect to the seat, the stem assembly moving between a first position wherein the stem assembly contiguously engages the seat such that fuel flow through the opening is prevented and a second position wherein the stem assembly is spaced from the seat such that fuel flow through the opening is permitted;

a first set of piezoelectric elements moving the stem assembly in response to a first electric field; and a second set of piezoelectric elements moving the first set of piezoelectric elements in response to a second electric field.

2. The fuel injector according to claim 1, wherein the first electric field moves the stem assembly between the first and second positions.

3. The fuel injector according to claim 2, wherein the second electric field also moves the stem assembly between the first and second positions.

4. The fuel injector according to claim 1, wherein movement in response to the second electric field at least partial compensates movement in response to the first electric field.

5. The fuel injector according to claim 4, wherein the movement in response to the second field compensates for physical changes in at least one of the tube and stem assemblies.

6. The fuel injector according to claim 5, wherein the physical changes include at least one of thermal expansion and mechanical deformation.

7. The fuel injector according to claim 1, wherein electromechanical extension and contraction of the first set of piezoelectric elements is along a first axis, and electromechanical extension and contraction of the second set of piezoelectric elements is along a second axis substantially parallel to the first axis.

8. The fuel injector according to claim 7, wherein the first and second axes are substantially collinear.

9. A fuel injector comprising:

a tube assembly having a longitudinal axis extending between a first end and a second end;

a seat secured at the second end of the tube assembly, the seat defining an opening;

a stem assembly movable with respect to the seat, the stem assembly moving along the axis between a first position wherein the stem assembly contiguously engages the seat such that fuel flow through the opening is prevented and a second position wherein the stem assembly is spaced from the seat such that fuel flow through the opening is permitted;

a first set of piezoelectric elements connected to the stem assembly, the first set of piezoelectric elements electromechanically extending and contracting along the axis in response to a first electric field; and a second set of piezoelectric elements connected to the first set of piezoelectric elements, the second set of piezoelectric elements electromechanically extending and contracting along the axis in response to a second electric field.

10. The fuel injector according to claim 9, wherein the first electric field moves the stem assembly between the first and second positions.

11. The fuel injector according to claim 10, wherein the second electric field also moves the stem assembly between the first and second positions.

12. The fuel injector according to claim 9, wherein movement in response to the second electric field at least partial compensates movement in response to the first electric field.

13. The fuel injector according to claim 12, wherein the movement in response to the second field compensates for physical changes in at least one of the tube and stem assemblies.

14. The fuel injector according to claim 13, wherein the physical changes include at least one of thermal expansion and mechanical deformation.

15. A method of actuating a fuel injector, the fuel injector including a tube assembly having a longitudinal axis extending between a first end and a second end, a seat secured at the second end of the tube assembly and defining an opening, a stem assembly movable with respect to the seat, the stem assembly moving along the axis between a first position wherein the stem assembly contiguously engages the seat such that fuel flow through the opening is prevented and a second position wherein the stem assembly is spaced from the seat such that fuel flow through the opening is permitted, a first set of piezoelectric elements connected to the stem assembly, and a second set of piezoelectric elements connected to the first set of piezoelectric elements, the method comprising:

applying a first electric field to the first set of piezoelectric elements, the first set of piezoelectric elements electromechanically extending and contracting along the axis in response to the first electric field; and applying a second electric field to the second set of piezoelectric elements, the second set of piezoelectric elements electromechanically extending and contracting along the axis in response to the second electric field.

16. The method according to claim 10, wherein the applying the first electric field moves the stem assembly a first displacement along the axis, the applying the second electric field moves the stem assembly a second displacement along the axis, and a total displacement of the stem assembly between the first and second positions is a sum of the first and second displacements.

* * * * *